US005282418A

United States Patent [19]

Uera

[11] Patent Number: 5,282,418

[45] Date of Patent: Feb. 1, 1994

[54] ROLLER CHANGER

[75] Inventor: Yoshinori Uera, Kawasaki, Japan

[73] Assignee: Tokyo Kikai Seisakusho, Ltd., Tokyo, Japan

[21] Appl. No.: 978,168

[22] Filed: Nov. 17, 1992

Related U.S. Application Data

[63] Continuation of Ser. No. 828,691, Jan. 31, 1992, abandoned.

[30] Foreign Application Priority Data

Mar. 13, 1991 [JP] Japan ..... 3-72026

[51] Int. Cl.[5] ..... B41F 13/20

[52] U.S. Cl. ..... 101/216; 101/479

[58] Field of Search ..... 101/153, 216, 247, 181, 101/DIG. 35, 479, 480, 152, 212; 242/58.6, 79; 414/911

[56] References Cited

U.S. PATENT DOCUMENTS

| | | | |
|---|---|---|---|
| 3,174,724 | 3/1965 | Verlik | 101/216 |
| 3,625,145 | 12/1971 | Heatley | 101/216 |
| 3,789,757 | 2/1974 | Motter et al. | 242/58.6 |
| 4,413,541 | 11/1983 | Biggar, III | 101/153 |
| 4,932,827 | 6/1990 | Schlunke et al. | 414/911 |
| 4,934,413 | 6/1990 | Yao | 242/58.6 |
| 5,010,813 | 4/1991 | Buffo | 414/911 |
| 5,055,755 | 10/1991 | Ozawa et al. | 901/15 |
| 5,074,207 | 12/1991 | Lubke et al. | 101/216 |

FOREIGN PATENT DOCUMENTS

| | | |
|---|---|---|
| 61-15145 | 1/1986 | Japan . |
| 2-108025 | 8/1990 | Japan . |

*Primary Examiner*—Edgar S. Burr
*Assistant Examiner*—Ren Yan
*Attorney, Agent, or Firm*—Armstrong, Westerman, Hattori, McLeland & Naughton

[57] ABSTRACT

A roller changer of this invention is disposed in a machine the rollers of which must be changed, such as in a rotary press. The roller changer includes manipulators disposed on a movable machine table, for handling rollers to be changed, a roller support unit disposed either integrally with, or separately from, the machine frame in such a manner as to exist inside the operation zone of the manipulators at least when the manipulators handle the rollers to be changed, and capable of supporting thereon the rollers to be changed, and a control unit for controlling at least the operation of the manipulators.

1 Claim, 3 Drawing Sheets

ROLLER CHANGER

This application is a continuation of application Ser. No. 07/828,691 filed Jan. 31, 1992, now abandoned.

BACKGROUND OF THE INVENTION

1. Field of the Invention

This invention relates to a roller changer for a machine, such as a rotary press, the rollers of which must be changed.

2. Description of the Prior Art

A rubber roller has been used in an inking arrangement of a rotary press as a roller for distributing ink between an ink cylinder and the roller and for transferring the ink to a printing plate in order to supply an uniform ink film onto the surface of the printing plate.

Surface quality of the rubber roller undergoes degradation with time and the roller itself must be changed, whenever necessary.

Conventional roller changers are described, for example, in Japanese Utility Model Laid-Open No. 15145/1986 and Japanese Utility Model Laid-Open No. 108025/1990.

In the first reference, i.e., Japanese Utility Model Laid-Open No. 15145/1986, the tips of a pair of roller support arms continuously provided to the rotary shaft which is disposed between the frames of a printing unit are engaged with both shaft end portions of a printing roller supported between the frames, and then the printing roller is released from support. The support arms are driven for rotation by a motor provided to the printing unit, and the printing roller can be taken out between the adjacent printing units. The printing roller is put onto a truck which is kept on standby between the printing units and is changed.

In the latter reference, i.e., Japanese Utility Model Laid-Open No. 108025/1990, a roller changer equipped with a stocker for storing arms and rollers that are moved back and forth by a hydraulic cylinder is moved into an arc of the printing unit and is set to a predetermined position. The arms are moved forth and engaged with the printing roller and after the cap of the support device of the printing roller is opened, the arms are moved back along guide rails disposed in the printing unit so that the roller can be guided and moved and is then stored in the stocker.

Next, the arms are engaged with a replacing roller which is in advance stocked and are guided and moved along the guide rails to the roller support device. Furthermore, the cap of the support device is closed so as to support the roller, and in this way, the roller is changed.

However, the apparatuses of the prior art involve the following problems.

In the apparatus described in Japanese Utility Model Laid-Open No. 15145/1986, the replacing arms and the driving motor must be disposed for each roller which needs to be changed in the printing unit. Therefore, the apparatus requires extremely wasteful investment.

In appartus described in Japanese Utility Model Laid-Open No. 108025/1990, the guide rail must be disposed for each roller which needs to be changed, on the machine frame. Therefore, the space for the guide rail becomes necessary. Since the guide rail is disposed, members which must be fitted to the frame surface of the machine become very complicated, and this places a greater burden on an operator at the time of maintenance and inspection. Moreover, this apparatus is solely directed to the rollers disposed inside the arc of the printing press.

For the reasons described above, the development of a roller changer which is simple is structure, can cope with any change of a roller which requires changing, and can reduce the burden on the operator are desired.

SUMMARY OF THE INVENTION

The roller changer in accordance with the present invention includes manipulators for handling a roller to be changed, which are disposed on a movable machine table, a roller support unit which is disposed either integrally with, or separately from, the machine table so that it exists inside the operation range of the manipulators at least when the manipulators handle the roller to be changed, and on which the roller to be changed can be placed, and a control unit for controlling at least the operation of the manipulators.

In the roller changer of the present invention, a new roller is placed in advance on the roller support unit. The roller changer is then moved towards the machine having the roller which is to be changed, and the manipulators are operated on the basis of the instruction from the control unit, handle the old roller to be changed, remove it from a fitting portion and place it on the roller support unit.

Next, the manipulators handle the new roller placed in advance on the roller support unit through the reverse route to the route of the old roller described above, move the new roller from the roller support unit to the fitting portion, fit it to the machine, and then return to their original posture. In this way, the old and new rollers are changed.

The roller changer is moved in such a manner as to move away from the machine, and the old roller placed on the roller support unit is collected.

BRIEF DESCRIPTION OF THE DRAWINGS

Other objects, features and advantages of the present invention will be described in the following with reference to the accompanying drawings, in which:

FIG. 1A is a structural front view of a roller changer in an embodiment of the present invention, while

DESCRIPTION OF THE PREFERRED EMBODIMENTS

The roller changer in the embodiment of the present invention will be explained with reference to the drawings.

There are a variety of machines in which the roller changer of the present invention can be disposed. In this embodiment, a printing unit of an offset rotary press is illustrated by way of example.

Figure 1A:
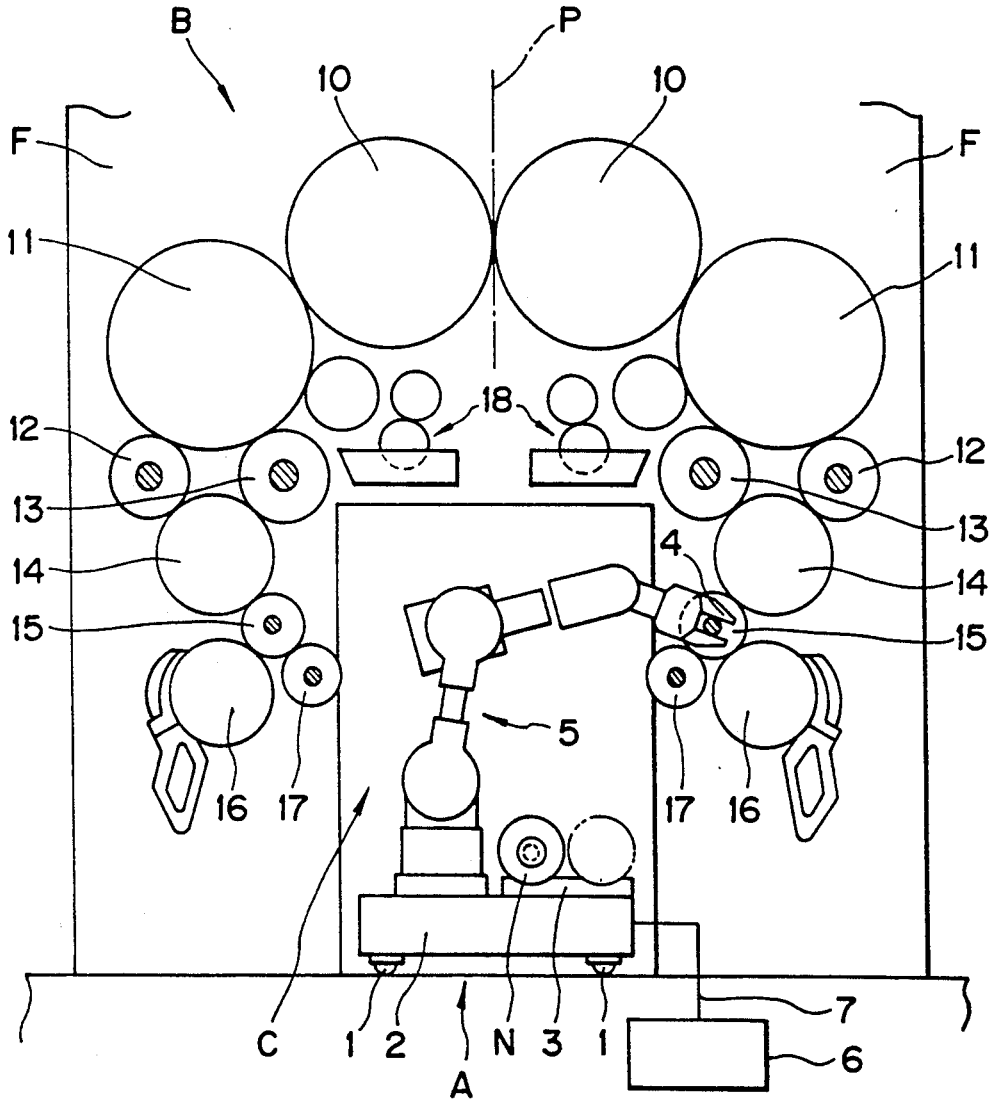
Figure 1B:
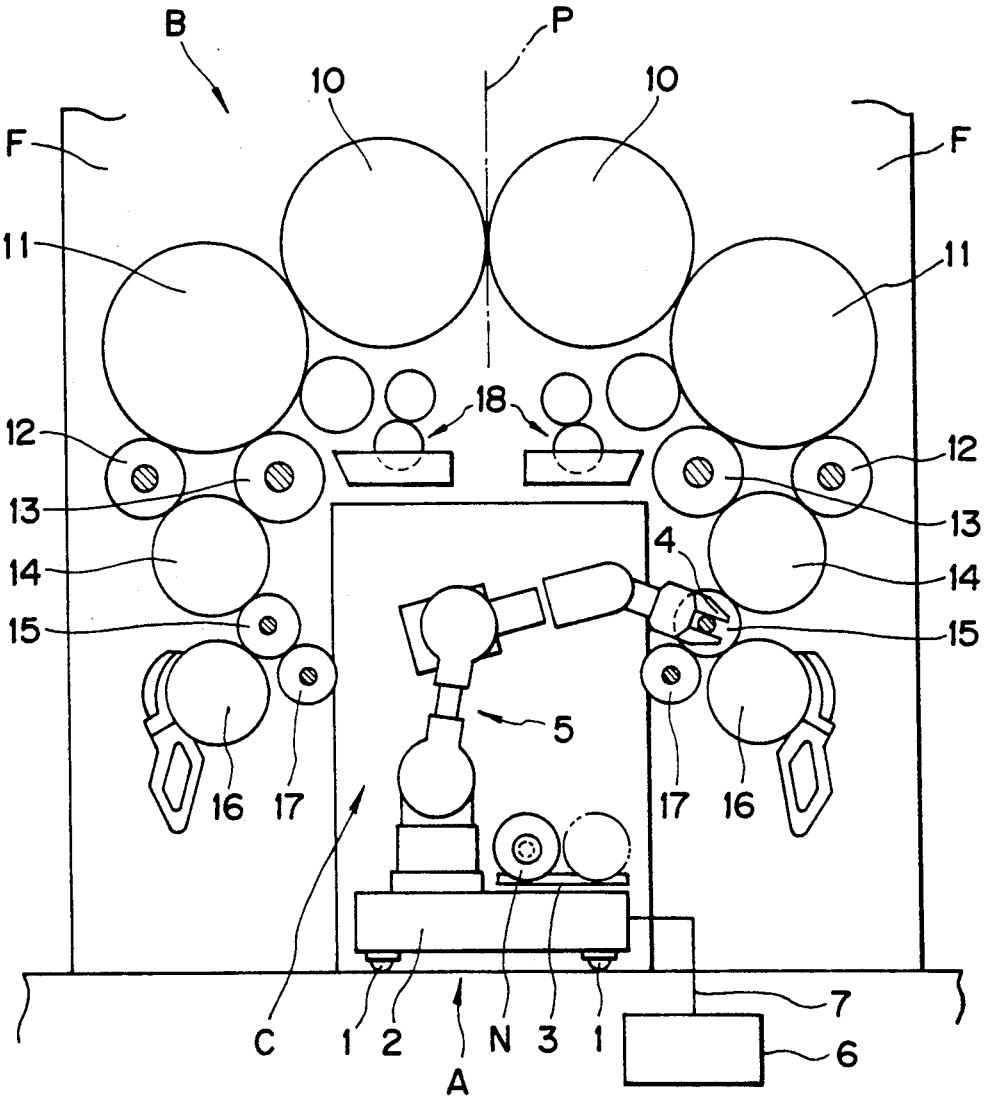
FIG. 1B is also a structural front view of a roller changer in an embodiment of the present invention similar to that shown in FIG. 1A, except that the roller support unit 3 is shown as being separate from the table 2.
Figure 2:
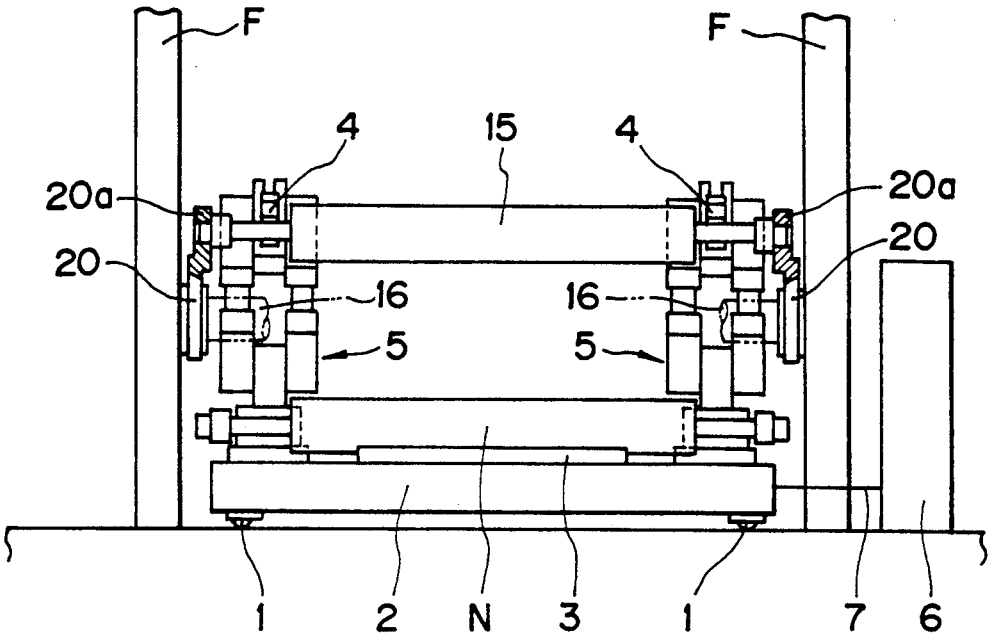
FIG. 2 is a partial structural side view of the embodiment of the present invention.

In the printing unit B of the offset rotary press shown in FIGS. 1A and 1B, blanket cylinders 10, 10 for printing elements on the surface of a printing plate onto a paper web P are so disposed as to interpose the paper web P between them and to be rotatably supported between machine frames F, F on both sides at both of their end portions. Plate cylinders 11, 11 having the printing plate fitted thereto, which comes into contact with each blanket cylinder 10, are also supported rotatably between both machine frames F, F at both of their end portions.

Roller trains for constituting ink supply paths to the plate cylinders 11 are so disposed as to face each other.

For convenience sake, the following description will be given only on one of the ink supply paths.

In the roller train constituting the ink supply path, a pair of rubber rollers 12, 13 which come into contact with the plate cylinder 11, an ink cylinder 14, a rubber roller 15 and an ink cylinder 16 are sequentially disposed in such a manner as to come into contact with one another, and another rubber roller 17 is so disposed as to keep contact with the rubber roller 15. A damping arrangement 18 is provided to the plate cylinder 11. Each of these rollers is rotatably supported between the machine frames F, F on both sides.

Figure 3:
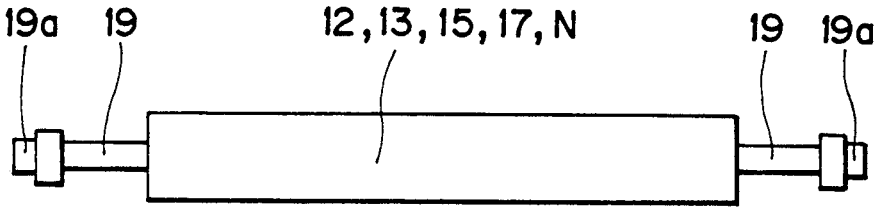
FIG. 3 is a front view of a roller which is replaced by the roller changer of the embodiment of the present invention.

As shown in FIG. 3, the rubber rollers 12, 13, 15 and 17 are particularly provided with a roller shaft 19, and the shaft end portions 19*a*, 19*a* of this shaft 19 are rotatably held by support portions 20*a* of support members 20, 20 that are appropriately disposed on the machine frames F, F.

A roller changer A is so disposed as to be capable of entering or coming out from the arc portion C between the roller trains that are disposed to oppose one another in the printing unit B, and fixing means (not shown) for fixing the roller changer A at a predetermined entry position at the time of the replacing of the roller is disposed inside the arc portion C.

The roller changer A has the construction wherein a roller support unit 3 which can support thereon old and new two rubber rollers and a pair of manipulators 5, 5 each equipped with a hand portion 4 for clamping the roller shaft 19 of each rubber roller at the end of its arm are disposed on a machine table 2 which is equipped with casters 1 on its lower surface and can freely move on the floor. The roller changer A is moved either automatically by suitable automatic guiding means or manually.

A control unit 6 for controlling the manipulators 5 is disposed outside the printing unit B, and can be connected to the roller changer A existing at a predetermined position for replacing the roller, by a cable 7. It is noted that the manipulators 5 are manufactured by, for example, Fujitsu, Ltd. of Kawasaki-shi, Japan; Hitachi, Ltd. of Tokyo, Japan; Kawasaki Heavy Industries, Ltd. of Tokyo, Japan; Mitsubishi Electric Corp. of Tokyo, Japan; or Nachi-Fujikoshi Corp. also of Tokyo, Japan.

A modified embodiment of the embodiment shown in the drawings is as follows. First of all, as to the machine table 2, the machine table on which the roller support unit 3 is disposed is separated from the machine table on which the manipulators 5, 5 are disposed, and these machine tables are appropriately connected and are permitted to move so that the roller support unit 3 exists inside the operation zone of the manipulators 5, 5, or they are allowed to individually move so that the roller support unit 3 exists inside the operation zone of the manipulators 5, 5 within the arc portion C.

Alternatively, the machine table 2 may be followed to move along the rails that are laid down along the moving path, and in the case of the automatic movement, the movement control of the machine table 2 may be effected by the control unit 6.

Furthermore, the control unit 6 may be disposed on the machine table.

The operation and function of the roller changer in the embodiment of the present invention will now be explained.

First of all, a new replacing rubber roller N is in advance placed on the roller support unit 3 of the roller changer A outside the printing unit B. the roller changer a is then moved either manually or automatically on the floor and while assuming the state in which the manipulators 5, 5 do not come into contact with the machine frame F, the roller changer A enters the arc portion C and is fixed at a predetermined entry position by the fixing means (not shown in the drawing). At the same time, it is connected d to the control unit 6 by the cables 7. When the automatic movement of the roller changer A is controlled by the control unit 6, the roller changer A is connected to the control unit 6 by the cables 7 before it is moved.

When the machine table of the roller support unit 3 and the machine table of the manipulators 5, 5 are separate and are not connected to each other, they are individually moved into the arc portion C and are then fixed so that the manipulators 5, 5 exist at predetermined entry positions and the roller support unit 3 exists inside the operation zone of each manipulator 5.

The pair of manipulators 5, 5 are operated on the basic of the instruction of the control unit 6 and execute the following operations.

The manipulators clamp the rubber roller to be changed such as the roller shaft 19 of the rubber roller 15 by their hand portions 4 and enter the stand-by state. In this case, the support portions 20*a*, 20*a* of the support means 20, 20 that clamp the shaft end portions 19*a*, 19*a* of the roller shaft 19 are operated either manually or by automatic operation means (not shown) disposed suitably on the manipulators 5 or on the machine frame F and release the shaft end portions 19*a*, 19*a* of the roller shaft 19.

The manipulators 5, 5 remove the rubber roller 15 from the support portions 20*a*, 20*a* of the support means 20, 20 while clamping the roller shaft 19 by their hand portions 4, and move and place it onto the roller unit 3.

Next, the manipulators 5, 5 clamp the roller shaft 19 of the new rubber roller N placed in advanced on the roller support unit 3 by their hand portions 4, pick up the new rubber roller N, move it in the path opposite to the moving path of the rubber roller 15 and fit the shaft end portions 19*a*, 19*a* of the roller shaft 19*a* to the support portions 20*a*, 20*a* of the support means 20, 20. Then, the support portions 20*a*, 20*a* are operated either manually or by the automatic operation means (not shown) described above and rotatably clamp the shaft end portions 19*a*, 19*a* of the roller shaft 19.

After removing the hand portions 4 from the roller shaft 19, the manipulators 5, 5 return to their original posture and in this way, the replacing old rubber roller with a new one is completed.

The roller changer A is released from the fixing means (not shown) and is disconnected from the control unit 6 through the cables 7, and are manually or automatically moved away from the arc portion C. The old replaced rubber roller 15 which is placed on the roller support unit 3 is collected. When the automatic movement of the roller changer A is controlled by the control unit 6, the connection of the roller changer A with the control unit 6 by the cables 7 is disconnected after the roller changer A moved outside.

When the control unit 6 is placed on the machine table 2, connection/disconnection of the cables 7 is omitted.

The roller replacing described above is made inside the arc portion C, but it is also possible to move and fix the roller changer A between the printing units and to change a roller that can be taken out therefrom, such as the rubber roller 12.

The roller of a spot printing unit (not shown) on the upstream side of the printing unit can also be changed. In this case, the rials are laid down in the operation space and the roller changer A may be suspended from them.

In the roller changer of this invention, the manipulators are disposed on the movable machine table so that the roller changing can be carried out. Accordingly, the roller change means need not be disposed for each printing unit and the movement and handling of the roller can be made accurately and reliably. Furthermore the guide means for moving the roller need not be disposed for each printing unit and the roller changing operation can be made for all the rollers which must be changed. In this way, any wasteful equipment can be eliminated and the equipment can be made more compact in scale. The surface of the machine frame can be put in trim order, and the burden on the operators inclusive of the maintenance and inspection can be reduced.

The present invention is not particularly limited to the embodiment described above but can of course be changed or modified without departing from the gist of the appended claim.

I claim:

1. An inking roller changer in combination with a printing machine having a space therebelow in the form of an arc along a set of roller trains in said printing machine, said inking roller changer comprising:

a movable machine table having a substantially planar upper surface; manipulator means disposed on said substantially planar upper surface of said movable table for handling rollers to be changed, each of said rollers being mounted onto a roller shaft and having roller ends thereof, wherein said manipulator means having hand portions for handling said roller shaft and for manipulating at least one of said rollers within said space therebelow said printing machine having the form of said arc along said set of roller trains in said printing machine;

a roller support means disposed integral with and on said substantially planar upper surface of said movable machine table for supporting thereon replacement rollers and rollers to be changed, said roller support means being placed within an operation zone of said manipulator means at least when said manipulator means handle said replacement rollers and said rollers to be changed, said roller support means having portions for directly receiving and supporting thereon at least one of said replacement rollers and said rollers to be changed; and control means, operably connected to said manipulator means and said movable machine table, for controlling at least an operation of said manipulator means while said manipulator means is completely within said space therebelow said printing machine and for controlling said movable machine table, having said manipulator means and said roller support means disposed thereon, through said space therebelow said printing machine.

* * * * *